US009366219B2

(12) United States Patent
Plotnikov

(10) Patent No.: US 9,366,219 B2
(45) Date of Patent: Jun. 14, 2016

(54) SYSTEM, CIRCUIT, AND METHOD FOR CONTROLLING COMBUSTION

(75) Inventor: Alexandre Plotnikov, Nepean (CA)

(73) Assignee: SPHENIC TECHNOLOGIES INC, Kemptville (CA)

( * ) Notice: Subject to any disclaimer, the term of this patent is extended or adjusted under 35 U.S.C. 154(b) by 286 days.

(21) Appl. No.: 13/984,631

(22) PCT Filed: Feb. 10, 2012

(86) PCT No.: PCT/CA2012/000113
§ 371 (c)(1),
(2), (4) Date: Aug. 9, 2013

(87) PCT Pub. No.: WO2012/106807
PCT Pub. Date: Aug. 16, 2012

(65) Prior Publication Data

US 2014/0020666 A1 Jan. 23, 2014

Related U.S. Application Data

(60) Provisional application No. 61/441,701, filed on Feb. 11, 2011, provisional application No. 61/485,770, filed on May 13, 2011.

(51) Int. Cl.

| | |
|---|---|
| ***F02P 1/00*** | (2006.01) |
| ***F02P 3/00*** | (2006.01) |
| ***F02P 23/04*** | (2006.01) |
| ***F23C 99/00*** | (2006.01) |
| ***F23N 5/12*** | (2006.01) |
| ***F02P 7/06*** | (2006.01) |
| ***F02P 9/00*** | (2006.01) |
| ***F23Q 3/00*** | (2006.01) |
| *F02P 3/01* | (2006.01) |
| *F02P 15/08* | (2006.01) |

(52) U.S. Cl.
CPC . *F02P 3/005* (2013.01); *F02P 7/06* (2013.01); *F02P 9/002* (2013.01); *F02P 23/04* (2013.01); *F23C 99/001* (2013.01); *F23N 5/123* (2013.01); *F23Q 3/004* (2013.01); *F02P 3/01* (2013.01); *F02P 15/08* (2013.01); *F23C 2900/99005* (2013.01)

(58) Field of Classification Search
CPC ..... F02P 13/00; F02P 15/00
USPC ..... 123/594, 609, 622, 626, 650
See application file for complete search history.

(56) References Cited

U.S. PATENT DOCUMENTS 4,585,982 A * 4/1986 Cooper et al. ..... 318/723
4,616,166 A * 10/1986 Cooper et al. ..... 318/712

(Continued)

FOREIGN PATENT DOCUMENTS

| | | |
|---|---|---|
| EP | 2180166 | 4/2010 |
| WO | 2009/079420 | 6/2009 |

OTHER PUBLICATIONS

Glow-to-Spark Transitions in Plasma System for Ignition and Combustion Control (Korolev et al.) Mar. 7, 2007, Special Issue of the IEEE Transactions on Plasma Science "Plasma-Assisted Combustion" *whole document*.

*Primary Examiner* — John Kwon
(74) *Attorney, Agent, or Firm* — Middleton Reutlinger

(57) ABSTRACT

A system, circuit, and method are provided for generating continuous plasma to control combustion including the ignition and maintenance of the combustion process. An electric potential difference is generated across a pair of electrodes in a combustible bulk gas in the form of an oscillating driving potential just below the arcing threshold which alternates in polarity to cause an alternating gap current between the electrodes which generates continuous plasma to contribute to combustion of the bulk gas by providing for more efficient combustion.

24 Claims, 7 Drawing Sheets

(56) References Cited

U.S. PATENT DOCUMENTS

| | | | | |
|---|---|---|---|---|
| 5,134,359 | A * | 7/1992 | Durley et al. | 324/71.1 |
| 5,549,795 | A * | 8/1996 | Gregoire et al. | 204/164 |
| 5,568,801 | A | 10/1996 | Paterson et al. | |
| 6,118,186 | A * | 9/2000 | Scott et al. | 290/40 B |
| 6,729,317 | B2 | 5/2004 | Kraus | |
| 2004/0038033 | A1 * | 2/2004 | Massler et al. | 428/408 |
| 2008/0309241 | A1 | 12/2008 | Starikovsky | |
| 2009/0126668 | A1 | 5/2009 | Shiraishi et al. | |
| 2010/0119879 | A1 * | 5/2010 | Girguis et al. | 429/2 |

* cited by examiner

SYSTEM, CIRCUIT, AND METHOD FOR CONTROLLING COMBUSTION

This Application is a national stage filing (35 U.S.C. §371) of PCT International Patent Application Serial Number PCT CA2012/000113, filed on Feb. 10, 2012, which claims the benefit under 35 U.S.C. 119(e) of U.S. Provisional Application No. 61/441,701 filed on Feb. 11, 2011, and also claims the benefit under 35 U.S.C. 119(e) of U.S. Provisional Application No. 61/485,770 filed on May 13, 2011. The entire contents of all of the aforementioned applications are fully incorporated by reference herein.

FIELD OF THE INVENTION

The invention relates to systems, circuits, and methods for controlling combustion, and more particularly to systems, circuits, and methods of ignition and regulation of controlled combustion processes.

BACKGROUND OF THE INVENTION

Controlled combustion is generally performed for generating heat and/or power and typically takes place within a controlled environment, such as within an engine or other apparatus within a combustion chamber. Chemical reactants, often in a liquid or gaseous state are mixed in the combustion chamber forming a bulk gas ready for combustion. In a typical vehicular combustion engine, fuel and air comprising oxygen are mixed in the combustion chamber and compressed. The combustion process itself is generally initiated and maintained by heating the bulk gas to a temperature at which free radicals, such as for example O, OH, and H in the case of combustion of hydrocarbons, are formed to initiate dissociation and oxidation reactions.

The heat required to initiate the process typically originates from a localized source such as a spark. In the case of a standard vehicular combustion chamber, the spark is generated between the electrodes of a spark plug extending into a portion of bulk gases in fluid communication with the bulk gases of the combustion chamber.

It has also been shown in the last few decades that electrical discharges that generate non-thermal (non-equilibrium) plasmas can serve as an alternative and efficient way to produce radicals and promote combustion. One publication which describes this is Penetrante B. M. and Schultheis S. E., "Non-Thermal Plasma Techniques for Pollution Control", NATO ASI Series G, Vol. 34, Parts A and B (1992).

Two well known ignition systems widely used are inductive discharge and capacitive discharge systems. These systems provide a single discharge spark suitable in most applications to initiate the combustion but are limited in influence on the combustion process.

Modern ignition systems aim for a controllable pattern of the discharge as disclosed, for example, in U.S. Pat. No. 6,729,317 to Kraus. Kraus describes how a high voltage switching polarity source should be used to drive the primary side of an ignition coil to produce spark discharge at high frequencies. Overall complexity limits the scalability and application of the system of Kraus.

The heat required to maintain the process after ignition typically is available from the combustion process itself. In a combustion process of hydrocarbon fuel and an oxidant (typically oxygen), since the chemical reaction is exothermic, as long as the conditions within the combustion chamber are appropriately controlled, such as the pressure and temperature of the unburned bulk gases, combustion of the bulk gases at the flame front generates enough heat to cause combustion of unburned bulk gas and propagates the chain reaction throughout the combustion chamber.

Complete molecular conversion during the process of combustion of pure hydrocarbons produces carbon dioxide and water. The chemical efficiency of this molecular conversion is dependent upon the generation and propagation of free radicals, which break carbon bonds. The generation, concentration, and propagation of these free radicals in turn depend largely upon the temperature of the bulk gases. To achieve sufficiently high temperatures for such conversion, a large amount of enthalpy is added to the bulk gases. These high temperatures may be achieved by direct heating, which as described above results from the exothermic reaction at the flame front, or a thermal electric arc which as described above may be used to initiate combustion.

The influence of electric discharge plasma on combustion processes has also been studied for several decades. Most of what is known about the effects of electric discharge plasma on combustion processes comes from studies of open flame combustion processes, and those studies strongly demonstrate improved stability, increased fuel efficiency and reduced emissions.

A class of known processes of initiating and maintaining combustion is described in "Method for igniting, intensifying the combustion or reforming of air-fuel and oxygen-fuel mixtures", U.S. Patent Application Publication No. 2008/0309241 by Starikovsky. Starikovsky describes a process which, for reduction of ignition temperature and intensification of chemical reactions, includes the excitation of the combustible mixture in the combustion chamber by means of pulsed periodic nanosecond high-voltage discharges. According to Starikovsky, the discharge amplitude is set to maximize gas dissociation, and to prevent electron transfer into the whistler mode at the basic stage of discharge. Furthermore, as described in Starikovsky, high-voltage rise time is limited by the constraint of attaining uniform filling of the discharge gap with plasma and the effectiveness of the pulse energy transfer to the plasma. Starikovsky also describes how the high-voltage pulse duration is limited by the constraints of attaining a strong non-equilibrium character of plasma and the reduction of the discharge gap resistance.

Starikovsky's method uses monopolar discharge to produce plasma. A monopolar series of pulses, if unrestrained, can result in a continuous electric arcing, or equilibrium plasma, due to the remaining conducting medium in the discharge gap region. Therefore, the method of Starikovsky requires the additional constraint of ensuring there is a delay between the pulses that exceeds the plasma recombination time, i.e. a limited pulse frequency which is effective. For this reason, overall density of non-equilibrium plasma produced is limited, and during the time delay spanning the pulses plasma density may actually momentarily decrease, which acts to limit the improvement thereby provided to the combustion. Moreover, the method of Starikovsky may be ineffective in fast progressing periodic combustion such as that found in internal combustion engines. The technical implementation of nanosecond high voltage techniques also requires highly complex and costly equipment and has to provide the necessary high levels of electromagnetic radiation protection.

It would be advantageous to provide a system, circuit, and method for controlling combustion that mitigate at least some of the problems of the prior art.

SUMMARY OF THE INVENTION

According to one aspect, the invention provides for a system for controlling combustion of a bulk gas, the system comprising: at least two electrodes for providing an electric potential difference varying over time to a portion of the bulk gas in a space spanned by the at least two electrodes when the bulk gas is in a ready for combustion state; and an electric potential difference generator for generating the electric potential difference and applying the electric potential difference to the at least two electrodes, the electric potential difference generated by the electric potential difference generator comprising: an oscillating driving potential alternating in polarity and for causing an alternating current to flow within the portion of bulk gas, and wherein the oscillating driving potential has a functional form such that arcing within the bulk gas caused by the driving potential is substantially avoided.

According to one aspect, the invention provides for a circuit for controlling combustion of a bulk gas, the circuit comprising: an input terminal for receiving control signals; a control unit connected to the input terminal for generating electric potential control signals with use of the control signals; a power supply for providing an electrical power signal; an electric potential difference generator connected to the power supply for receiving the electrical power signal and connected to the control unit for receiving the electric potential control signals, the electric potential difference generator for generating an electric potential difference varying over time with use of the electrical power signal, and with use of the electric potential control signals; and at least two output terminals connected to the electric potential difference generator for receiving the electric potential difference, the at least two output terminals for electrical connection to at least two external electrodes for outputting the electric potential difference, the at least two external electrodes for providing the electric potential difference to a portion of the bulk gas in a space spanned by the at least two external electrodes when the bulk gas is in a ready for combustion state, wherein the electric potential difference provided by the at least two external electrodes comprises: an oscillating driving potential alternating in polarity and for causing an alternating current to flow within the portion of bulk gas, wherein the oscillating driving potential has a functional form such that arcing within the bulk gas caused by the driving potential is substantially avoided.

According to one aspect, the invention provides for a method of controlling combustion of a bulk gas, the method comprising: providing a bulk gas in a ready for combustion state; providing an electric potential difference varying over time to a portion of the bulk gas in a space spanned by at least two electrodes, wherein providing the electric potential difference comprises: providing an oscillating driving potential of the electric potential difference alternating in polarity and for causing an alternating current to flow within the portion of bulk gas, wherein the oscillating driving potential has a functional form such that arcing within the bulk gas caused by the driving potential is substantially avoided.

According to one aspect, the invention provides for a system for generating continuous plasma to control combustion of a bulk gas, the system comprising: at least two electrodes for providing an electric potential difference varying over time to a portion of the bulk gas in a space spanned by the at least two electrodes when the bulk gas is in a ready for combustion state; and a continuous plasma generator for generating a continuous plasma in the space spanned by the at least two electrodes by generating the electric potential difference and applying the electric potential difference to the at least two electrodes, the electric potential difference such that arcing within the bulk gas is substantially avoided.

According to another aspect, the invention provides for a circuit for generating continuous plasma to control combustion of a bulk gas, the circuit comprising: an input terminal for receiving control signals; a control unit connected to the input terminal for generating electric potential control signals with use of the control signals; a power supply for providing an electrical power signal; at least two output terminals, the at least two output terminals for electrical connection to at least two external electrodes and for outputting the electric potential difference to the at least two external electrodes, the at least two external electrodes for providing the electric potential difference to a portion of the bulk gas in a space spanned by the at least two external electrodes when the bulk gas is in a ready for combustion state; and a continuous plasma generator connected to the power supply for receiving the electrical power signal, connected to the control unit for receiving the electric potential control signals, and connected to the at least two output terminals for providing the electric potential difference to the at least two output terminals, the continuous plasma generator for generating a continuous plasma in the space spanned by the at least two external electrodes by generating the electric potential difference varying over time with use of the electrical power signal, and with use of the electric potential control signals, the electric potential difference such that arcing within the bulk gas is substantially avoided.

According to a further aspect, the invention provides for a method of generating continuous plasma to control combustion of a bulk gas, the method comprising: providing a bulk gas in a ready for combustion state; generating a continuous plasma in a space spanned by at least two electrodes by providing an electric potential difference varying over time to a portion of the bulk gas in the space, the electric potential difference such that arcing within the bulk gas is substantially avoided.

According to yet another aspect, the invention provides for a system for controlling combustion of a bulk gas, the system comprising: at least one bulk gas stimulator element for providing a time-varying physical influence upon a portion of the bulk gas when the bulk gas is in a ready for combustion state; and a continuous plasma generator for controlling the time-varying physical influence provided by the at least one bulk gas stimulator element such that a continuous plasma is generated within the portion of the bulk gas, the continuous plasma comprising a continuously generated non-equilibrium plasma.

According to yet a further aspect, the invention provides for a method for controlling combustion of a bulk gas, the method comprising: providing a bulk gas in a ready for combustion state; stimulating a portion of the bulk gas by providing a time-varying physical influence upon the portion of the bulk gas; and controlling the time-varying physical influence provided to the portion of the bulk gas such that a continuous plasma is generated within the portion of the bulk gas, the continuous plasma comprising a continuously generated non-equilibrium plasma.

BRIEF DESCRIPTION OF THE DRAWINGS

The features and advantages of the invention will become more apparent from the following detailed description of the preferred embodiment(s) with reference to the attached figures, wherein.

It is noted that in the attached figures, like features bear similar labels.

DETAILED DESCRIPTION OF THE PREFERRED EMBODIMENTS

Figure 1:
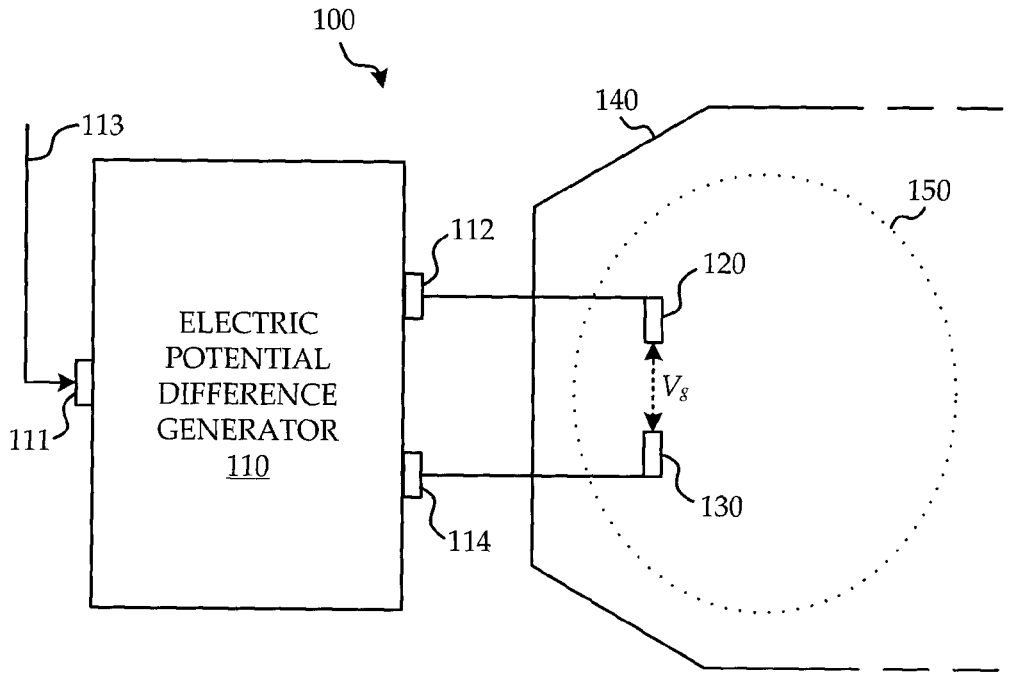
FIG. 1 is a block diagram illustrating a system for controlling combustion according to an embodiment of the invention.

Referring to FIG. 1, a system 100 for controlling combustion in accordance with a first embodiment of the invention will now be discussed in terms of its structure. By way of a specific and non-limiting example, the system 100 is for generating continuous plasma to control combustion. Continuous plasma, as referred to herein, is to be understood to mean a spatial non-equilibrium plasma formed in a continuous fashion (without interruption) and having a variable power profile. A non-equilibrium plasma is inherently unstable and hence in order to ensure continuous generation, it is generated with a continuously varying power profile. Although at least some of the embodiments hereinbelow are directed to generating a non-equilibrium plasma with a regular periodically alternating source, other variations in accordance with the invention are possible, including but not limited to irregular and/or aperiodic alternating sources. Various embodiments described hereinbelow provide a source of continuous plasma via electric discharge of alternating polarity, which has an appropriate magnitude and period so as to prevent plasma pinching, and provide for fracturing of the traces of ionized particles, and controlling the energy deposition. The continuous plasma generated by the various embodiments described below is believed to serve as a source of ionizing radiation within the combustion volume and is believed to have a remote influence on flame front formation and propagation. Specifically, the flame front is believed to become more laminar, which serves to reduce the formation of high temperature spots and shock waves, as a result, improving thermal efficiency and reducing emissions. The continuous plasma generated by the various embodiments described below is also believed to serve to treat both the combustion reactants forming free radicals and the combustion products to generally neutralize nitrogen oxide. This treatment of the reactants and products is not limited locally to the source of the continuous plasma, but instead is believed to spread throughout the combustion volume.

The system 100 generally comprises an electric potential difference generator 110 and a combustion chamber 140 which holds a volume of combustible bulk gas 150. The continuous plasma generator 110 has a first terminal 112 electrically coupled to a first electrode 120 situated within the combustion chamber 140 and has a second terminal 114 electrically coupled to the second electrode 130 situated within the combustion chamber 140. The first electrode 120 and the second electrode 130 within the combustion chamber 140 are separated by a relatively small gap. A region spanned by the first and second electrodes 120, 130 is surrounded by a small volume 160. The electric potential difference generator 110 has an input port 111 electrically coupled to control conduit 113, which may comprise one or more individual physical signal lines or wireless channels.

Figure 2A:
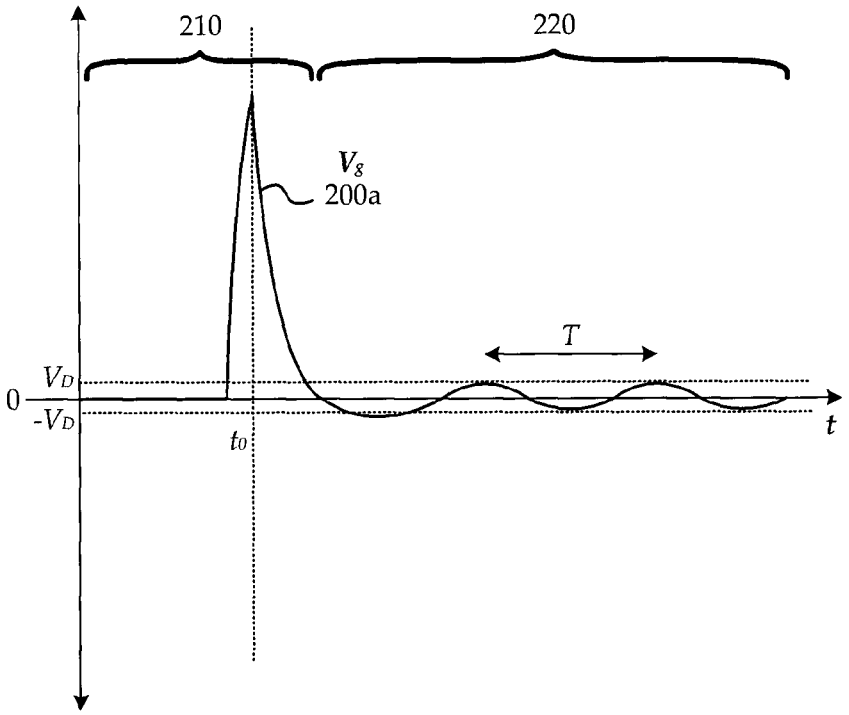
FIG. 2A illustrates an electric potential difference applied across the electrodes of the system of FIG. 1, according to an embodiment of the invention.
Figure 2B:
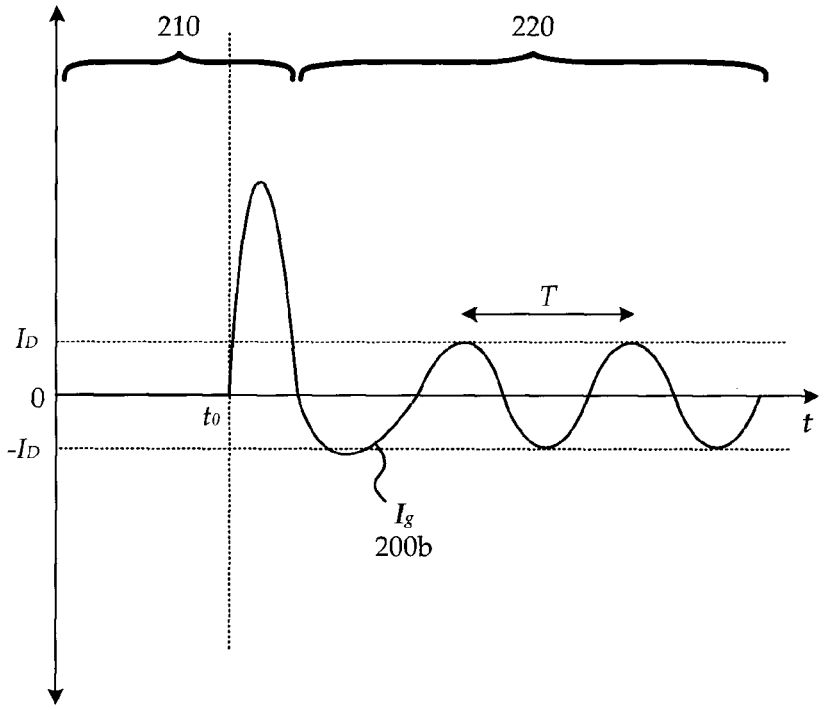
FIG. 2B illustrates a resulting current flowing between the electrodes of the system of FIG. 1, according to an embodiment of the invention.

The system 100 will now be discussed in terms of its function also with reference to FIG. 2A and FIG. 2B which respectively illustrate the general form of the electric potential difference $V_g$ 200*a* generated by the electric potential difference generator 110, and the resulting gap current $I_g$ 200*b* flowing through the bulk gas 150 caused by the potential difference $V_g$. The electric potential difference generator 110 provides an electric potential difference $V_g$ 200*a* between the first electrode 120 and the second electrode 130 for controlling combustion of the combustible bulk gas 150 in the combustion chamber 140 which includes the ignition and maintenance of combustion. In a particular embodiment, the electric potential difference generator 110 is a continuous plasma generator. During maintenance of combustion, the continuous plasma generator provides a continuous plasma in the small volume 160 surrounding the region spanned by the first electrode 120 and the second electrode 130 by providing an alternating current (described below) between the first electrode 120 and the second electrode 130. As is described in more detail below, the electric potential difference generator 110 is used to generate the electric potential difference in order to cause the bulk gas 150 to be subjected to two physical processes: electrical breakdown in the bulk gas 150; and thereafter the alternating current $I_g$ 200*b* passing through the bulk gas 150 to generate the continuous plasma.

The electric potential difference generator 110 controls how the electric potential difference $V_g$ 200*a* varies with time, including polarity and magnitude, with use of analog or digital control signals received over the control conduit 113. In some embodiments, the control signals comprise rough parameterization values for the electric potential difference generator's 110 use in generating the time varying electric potential difference $V_g$ 200*a*. These may include magnitude, timing, and functional form values as discussed below. In other embodiments the control signals represent the time varying values of the electric potential difference $V_g$ 200*a* itself, which the electric potential difference generator 110 uses to generate an actual electric potential difference $V_g$ 200*a* which varies accordingly. The actual form of $V_g$ 200*a* and the physical effects it causes within the bulk gas 150 is described below.

Figure 3:
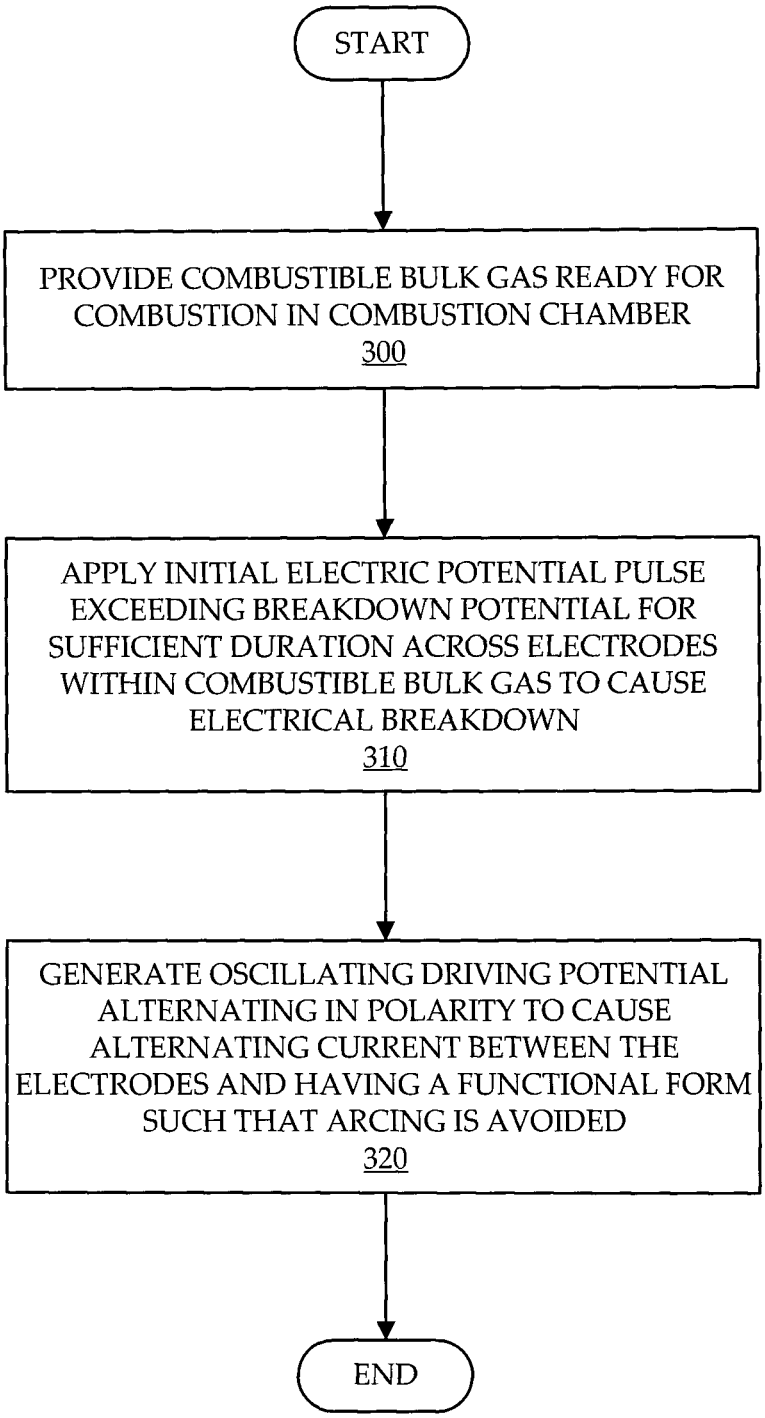
FIG. 3 is a functional block diagram illustrating a method of controlling combustion according to an embodiment of the invention.

The functioning of the system in accordance with a method of controlling combustion (i.e., generating continuous plasma to control combustion) according to an embodiment of the invention will now be described also with reference to FIG. 3. The combustible bulk gas 150 is provided in the combustion chamber 140 and is at the desired pressure and temperature such that it is ready for combustion in step 300.

The electric potential difference generator 110 provides an electric potential difference $V_g$ which comprises two phases, an initial discharge phase 210 in which the electric potential difference is for physically causing electrical breakdown of the bulk gas 150 in the gap between the electrodes as described below, and a combustion maintenance (i.e., continuous plasma generation) phase 220 in which the electric potential difference alternates to physically cause an alternating gap current $I_g$ to pass through the bulk gas between the electrodes 120, 130, such as to continually generate non-equilibrium plasma. Although it is believed that the benefits described hereinbelow obtain primarily only due to the application of the oscillating electric potential difference of the combustion maintenance phase 220 to generate non-equilibrium plasma, it has nevertheless been found to be convenient to use the electrodes to supply the energy to cause breakdown during the initial discharge phase 210. As such the embodiments described hereinbelow are to be understood as necessarily providing some form of oscillating driving potential but only optionally providing the pulse of the initial discharge phase, since other methods and mechanisms to provide breakdown may be utilized.

During the initial discharge phase 210, the electric potential difference generator 110 generates a signal comprising at least one initial electric potential pulse having a peak magnitude and a peak width which are sufficient to cause electrical breakdown in the bulk gas 150 across the gap between the first and second electrodes 120, 130. Electrical breakdown of the bulk gas 150 occurs when what is known as the breakdown voltage potential is exceeded between the first and second electrodes 120, 130 for a sufficiently long duration of time as shown in step 310. Although the value of the breakdown potential and the duration of time for which it must be applied depend upon a number of factors, including but not limited to, the particular conditions of the bulk gas 150 in the combustion chamber 140 such as its temperature, pressure, and turbulence, the composition of the particular bulk gas 150, and the size, form, and spacing of the electrodes 120, 130, the value of the breakdown potential and duration of time for which it must be applied given any particular set of conditions, is measurable and in general may be easily determined by skilled persons in the art.

Although the initial electric potential pulse of the initial discharge phase 210 is depicted as having a positive polarity, it is clear that the polarity of the initial electric potential pulse could also be negative. What is important is that the peak magnitude of the initial electric potential pulse exceeds the breakdown potential and does so for a sufficiently long duration (i.e. with enough energy) to cause electrical breakdown of the bulk gas 150. Although the initial electric potential pulse of the initial discharge phase 210 is depicted as having a peak of a specific shape, any form of pulse which exceeds the breakdown potential for a sufficient duration of time to cause electrical breakdown is suitable.

In the course of causing electrical breakdown, the electric potential difference applied between the first and second electrodes 120, 130 causes, in the absence of any appreciable current, avalanche ionization of the bulk gas within the small volume 160. Thereafter, breakdown occurs as current begins to flow between the first and second electrodes 120, 130. As current begins to flow, a magnetic field begins to form. The orientation of the magnetic field is such that the current is squeezed perpendicular to its direction of motion, thereby increasing the magnetic field, in a positive feedback loop, causing the current to be more concentrated into a single conduit between the electrodes. This constitutes the plasma pinching effect, is accompanied by formation of equilibrium plasma, and electrical breakdown of the bulk gases between the electrodes ensues, as resistance to current reduces drastically.

Although the initial discharge phase 210 has been illustrated as having a single initial electric potential pulse and a single polarity, the initial discharge phase 210 may include more than one appropriate initial electric potential pulse of either polarity.

After applying the at least one initial electric potential pulse of the initial discharge phase 210 to initiate electrical breakdown, the electric potential difference generator 110 begins the combustion maintenance phase 220 by generating an oscillating driving potential between the electrodes 120, 130 in order to physically cause an alternating gap current $I_g$ 200*b* within the bulk gas 150 as shown in step 320. As shown in the plot of $I_g$ the gap current 200*b* in FIG. 2B, during the early part of the initial discharge phase 210, although large electric potential differences are applied between the electrodes 120, 130, until the time to when electrical breakdown of the bulk gas 150 occurs, no significant current flows through the bulk gas 150. As can be seen in FIG. 2B, once breakdown has occurred at time to, the characteristics of the bulk gas 150 change so that the electric potential difference applied across the gap between the electrodes 120, 130 easily causes current to flow therethrough. The oscillating driving potential of the combustion maintenance phase 210 reverses in polarity over time, has a peak driving magnitude of $V_D$, and causes an oscillating gap current $I_g$ 200*b* having a peak magnitude of $I_D$. During a short preliminary ignition delay, the oscillating driving potential contributes to the process of ignition, by helping to form and maintain a fire ball in and around the gap, until flame propagation can begin. As such, ignition relies upon the occurrence of both the initial electric potential pulse causing electrical breakdown and the initial portion of the oscillating driving potential immediately thereafter, until flame propagation occurs, rather than relying only upon one or the other.

Either the peak magnitude $V_D$ of the electric potential difference $V_g$ 200*a* is small enough or the energy of each crest of the waveform is small enough so as to avoid further electrical arc discharging in the gap between the electrodes 120, 130. In some embodiments of the invention the peak magnitude $V_D$ is selected so as to avoid the occurrence of arcing and reduce the magnitude of any arcing discharge if it were to occur within the gap while at the same time providing as much current as possible. In some embodiments, the peak magnitude $V_D$ is such that the discharge current within the gap between the electrodes 120, 130 is at or just below the arcing threshold. In some embodiments, the peak magnitude $V_D$ is such that the discharge current is of a magnitude within a range of ±20% of the arcing threshold.

The alternating gap current $I_g$ 200*b* passing through the bulk gas 150 between the electrodes 120, 130, is such that avalanche ionization occurs but without any appreciable magnetic field formation or plasma pinching which normally occurs during arcing. This is achieved by reversal of polarity at a frequency sufficient to avoid the positive feedback loop that causes plasma pinching. Through this process, a non-equilibrium plasma is generated continuously. The continuous creation of non-equilibrium plasma allows the improvement and maintenance of the combustion process by providing advantages which occur throughout the combustion process and which are described below, moreover, without interruption.

Although various peak driving magnitudes $V_D$ may be used, peak driving magnitudes $V_D$ having a magnitude physically causing peak gap current magnitudes $I_D$ of the gap current $I_g$ 200*b* of about one third the magnitude of the peak gap current caused during the initial electric potential pulse of the initial discharge phase 210 have been found particularly well suited to give rise to the benefits described hereinbelow, although other peak driving magnitudes $V_D$ are also effective to some degree. The peak driving magnitudes $V_D$ which generate alternating gap currents $I_g$ which are particularly well suited to providing the beneficial results described hereinbelow, and the value of the arcing threshold itself, both depend upon a number of factors, including but not limited to, the particular size and shape of the combustion chamber 140, the particular conditions in the combustion chamber 140 including temperature, pressure, and turbulence, the composition of the particular bulk gas 150, the size, form, and spacing of the electrodes 120, 130, where they are situated, the rate and manner at which the combustion chamber 140 is filled with bulk gas 150 and evacuated of the combustion products. The peak driving magnitudes $V_D$ which create an alternating gap current $I_g$ particularly well suited to providing the beneficial results described hereinbelow may be measured in any particular application, and in general may be determined.

Although various periods T of oscillation may be used, a period of about $3.33\times10^{-5}$ s, corresponding to a frequency of about 30 kHz has been found to be particularly well suited to give rise to the benefits described hereinbelow, although various other periods and corresponding frequencies of similar orders of magnitude ($1\times10^{-3}$ s-$1\times10^{-5}$ s or 1 kHz-100 kHz) are also effective to some degree depending upon the particular application and conditions. In some embodiments the frequency is on the order of the 0 free radical recombination time (approximately 30 μs). The period of oscillation which is particularly well suited to providing the beneficial results described hereinbelow may depend upon a number of factors, including but not limited to, the particular size and shape of the combustion chamber 140, the particular conditions in the combustion chamber 140 including temperature, pressure, and turbulence, the composition of the particular bulk gas 150 and the recombination time of the free radicals involved in the combustion, the size, form, and spacing of the electrodes 120, 130, where they are situated, the rate and manner at which the combustion chamber 140 is filled with bulk gas 150 and evacuated of the combustion products. The period of oscillation which is particularly well suited to providing the beneficial results described hereinbelow may be measured in any particular application, and in general may be determined.

Although the oscillating driving potential of the combustion maintenance phase 220 and hence the resulting alternating gap current $I_g$ 200*b* are depicted as sinusoidal waveforms, any form of oscillating potential which reverses in polarity, and does not cause further electrical arcing, and possesses a $V_D$ and T adapted to the particular application is suitable. As such, other repeating and polarity reversing waveforms may be used as the oscillating driving potential of the combustion maintenance phase 220 to generate the alternating gap current $I_g$ 200*b* to maintain the combustion process.

In some embodiments, the oscillating driving potential of the combustion maintenance phase 220 causing an alternating gap current $I_g$ 200*b* is generated by the electric potential difference generator 110 for the entire duration of combustion i.e. it is not stopped until all or substantially all of the bulk gas 150 in the combustion chamber 140 has undergone conversion. Generally speaking, the beneficial results described hereinbelow are obtained to a larger degree the longer the duration of continuous plasma generation caused by the alternating gap current $I_g$ 200*b* generated during the combustion maintenance phase 220.

Embodiments according to the invention were investigated by testing the influence of the alternating gap current $I_g$ 200*b* generated by the oscillating driving signal (i.e., continuous plasma generation) on a combustion process using a single cylinder internal combustion engine. In-cylinder pressure measurement was acquired at different running conditions and various discharge shapes. A thermodynamic analysis of pressure traces was conducted to estimate the combustion behavior.

FIG. 4, FIG. 5, FIG. 6, and FIG. 7 show a comparison between "short" (solid line) and "long" (dashed line) application of electric potential signals for continuous plasma generation in the region 160 between the electrodes 120, 130. In each graph, the initial electric potential pulses of the initial discharge phases 210 are formed with identical discharge shapes, starting at the same crank position, while the oscillating driving potential and resulting alternating gap current $I_g$ of the combustion maintenance phase 220 of each of the graphs differs only in duration of generation. Short application of signal covers the duration of ignition delay which was about 1 ms in the test set-up, while long application of the signal covers the entire duration of combustion.

Figure 4:
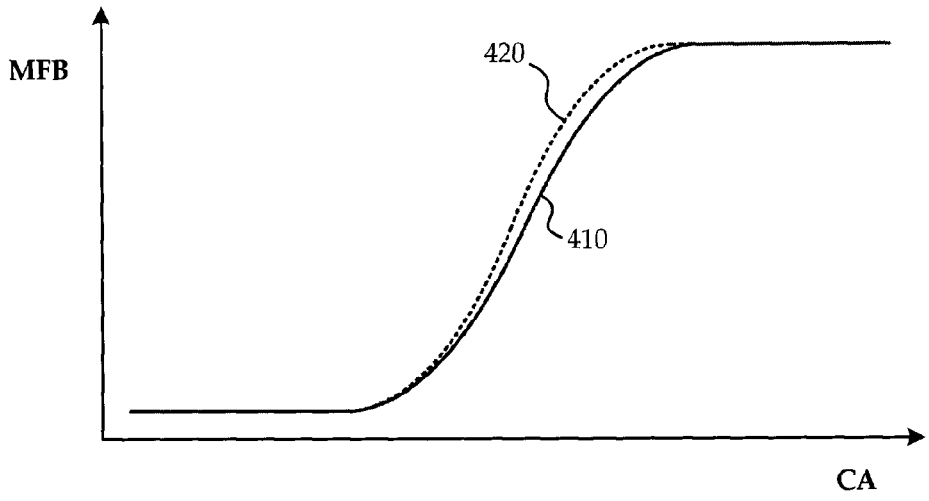
FIG. 4 illustrates mass fraction burned versus crank angle for long and short signal application under high load/high RPM conditions.

FIG. 4 shows the mass fraction burned (MFB) as a function of crank angle (CA) during high load/high RPM conditions, which is characterized by high motoring pressure and high turbulence inside the cylinder. The MFB curve for the long signal application 420 is slightly divergent from that of the short signal application 410.

Figure 5:
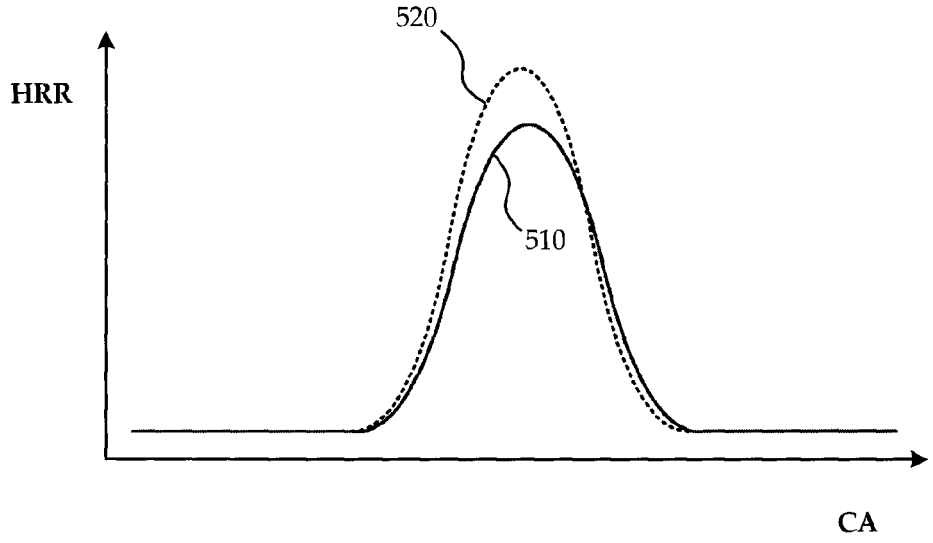
FIG. 5 illustrates heat release rate versus crank angle for long and short signal application under high load/high RPM conditions.

FIG. 5 shows the heat release rate (HRR) as a function of crank angle (CA) during high load/high RPM conditions, which is characterized by high motoring pressure and high turbulence inside the cylinder. The HRR curve for the short signal application 510 possesses a smaller peak magnitude than that of the curve for the long signal application 520 and the area under the curve, which reflects the amount of heat released, for the short signal application 510 is significantly smaller than that of the curve for the long signal application 520. Clearly the longer application of the oscillating driving potential to create an alternating gap current $I_g$ 200*b* of longer duration advantageously causes more heat to be released.

Figure 6:
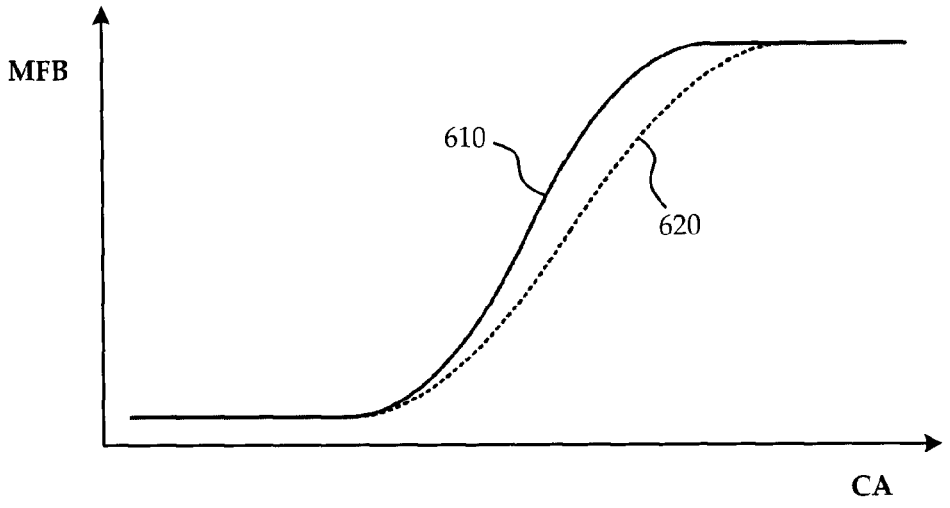
FIG. 6 illustrates mass fraction burned versus crank angle for long and short signal application under low load/low RPM conditions.

FIG. 6 the mass fraction burned (MFB) as a function of crank angle (CA) during low load/low RPM conditions, which is characterized by low motoring pressure and low turbulence inside the cylinder. The MFB curve for the long signal application 620 is delayed considerably in comparison to that of the short signal application 610. This shows that longer application of the oscillating driving potential to create an alternating gap current $I_g$ 200*b* of longer duration causes slower burning.

Figure 7:
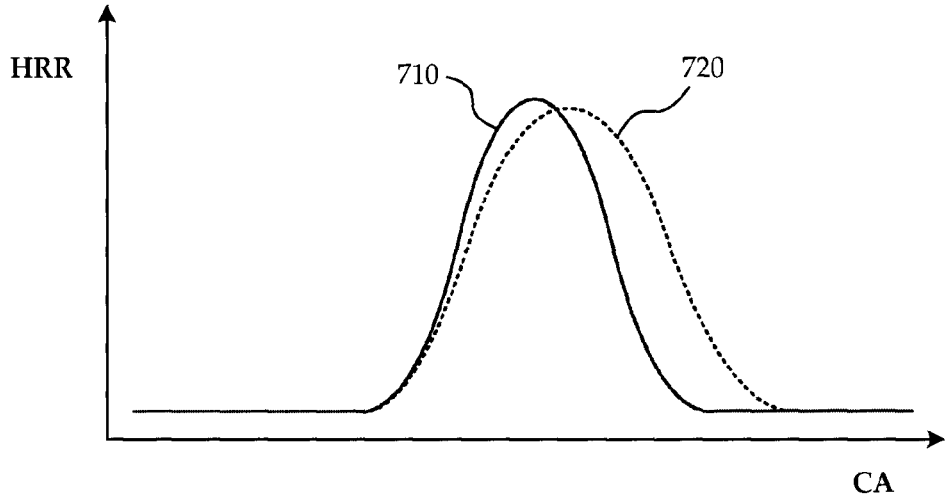
FIG. 7 illustrates heat release rate versus crank angle for long and short signal application under low load/low RPM conditions.

FIG. 7 shows the heat release rate (HRR) as a function of crank angle (CA) during low load/low RPM conditions, which is characterized by low motoring pressure and low turbulence inside the cylinder. The HRR curve for the short signal application 710 possesses a peak magnitude which is substantially similar to that of the curve for the long signal application 720 but the area under the curve, which reflects the amount of heat released, for the short signal application 710 is significantly smaller than that of the curve for the long signal application 720. Clearly the longer application of the oscillating driving potential to create an alternating gap current $I_g$ 200*b* of longer duration advantageously causes more heat to be released.

Some of the mechanisms at play, i.e., caused by the continuous plasma generation arising from an alternating current which influence combustion of the bulk gases, are believed to be as follows. The continuous plasma maintains an impact on the flame front far from the pair of electrodes 120, 130, i.e. the beneficial results continue to obtain even as the flame front moves away from the small volume 160. The continuous non-equilibrium plasma stabilizes the flame and lowers temperature, which slows down flame propagation under some conditions. This results in more energy being released during combustion which is transferred to heating the bulk gases which results in greater working pressure and less energy transferred to the walls of the combustion chamber which would otherwise occur due to shock waves and excessive flame turbulence. Bursts of ionizing radiation are generated during the continuous plasma generation at the same frequency as the switching of polarity of the alternating current. As described above, in some embodiments the frequency is set to roughly the inverse of the relaxation or recombination time for the free radicals of the combustion reactants.

Figure 8:
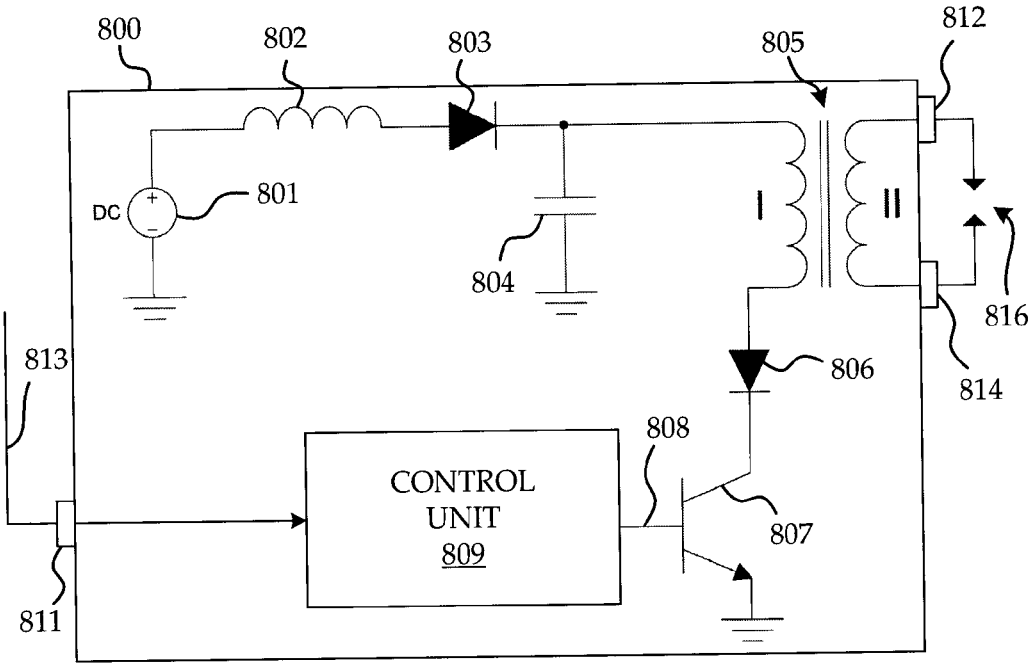
FIG. 8 is a circuit diagram of a circuit according to an embodiment of the invention.

Referring now to FIG. 8, a system including a specific electric potential generating circuit 800 for controlling combustion according to an embodiment of the invention will now be described. By way of a specific and non-limiting example, the specific electric potential generating circuit 800 is a continuous plasma generating circuit for controlling combustion.

The electric potential generating circuit 800 comprises three semiconductor elements: a first diode 803; a second diode 806; and a transistor switch 807, and three passive components: an inductor 802; a capacitor 804, and a transformer also referred to as an ignition coil 805. The electric potential generating circuit 800 also comprises a control unit 809 which is coupled to a gate of the transistor switch 807 for controlling the switching function of the switch 807. The electric potential generating circuit 800 also includes a DC power supply 801.

A negative side of the DC power supply 801 is coupled to ground while a positive side of the DC power supply 801 is connected to the inductor 802 which is coupled to the anode of the first diode 803. The capacitor 804 is coupled to ground on one side and coupled on its un-grounded side to a cathode of the first diode 803. The cathode of the first diode 803 is also coupled to a first end of a primary winding (I) of the ignition coil 805. A second end of the primary winding (I) of the ignition coil 805 is connected to an anode of the second diode 806. A cathode of the second diode 806 is connected to a source of the transistor switch 807. A gate of the transistor switch 807 is connected over a control line 808 to an output of the control unit 809. A drain of the transistor switch 807 is connected to ground. An input of the control unit 809 is coupled to an input port 811 of the electric potential generating circuit 800. The input port 811 is coupled to a control conduit 813. A secondary winding (II) of the ignition coil 805 is coupled at one end to a first terminal 812 of the electric potential generating circuit 800 and at a second end to a second terminal 814 of the electric potential generating circuit 800. The first and second terminals 812, 814 of the electric potential generating circuit 800 are coupled externally to respective external electrodes forming a discharge gap 816 which is for being used within a bulk gas 150 of a chamber 140 as shown in FIG. 1.

The electric potential generating circuit 800 may be analytically decomposed into four subcircuits. A first subcircuit (not shown on the figure for clarity) is a series closed circuit comprising ground, the DC power supply 801, the inductor 802, the first diode 803, the capacitor 804, and ground. A second subcircuit is a series closed circuit comprising ground, the capacitor 804, the primary winding (I) of the ignition coil 805, the second diode 806, and the transistor switch 807, and ground. A third subcircuit is a series closed circuit comprising ground, the DC power supply 801, the inductor 802, the first diode 803, the primary winding of the ignition coil 805, the second diode 806, the transistor switch 807, and ground. A fourth subcircuit is a series closed circuit comprising the secondary winding of the ignition coil 805 connected by the first and second terminals 812, 814 to the external pair of electrodes forming the discharge gap 816.

The control conduit 813 which is coupled to the input port 811 of the electric potential generating circuit 800, may comprise one or more individual physical signal lines or wireless channels. In some embodiments the control conduit 813 provides communication of control signals from an engine control unit (ECU) or separate controller which provides a pattern of control data which the electric potential difference circuit 800 uses to generate the desired electric potential difference across the discharge gap 816, and hence, cause the desired electrical breakdown of the bulk gas 150 and cause an alternating gap current to flow between the electrodes of the discharge gap 816. In these embodiments, current feedback from of the transistor switch 807 could also be provided to the control unit 809.

Figure 9:
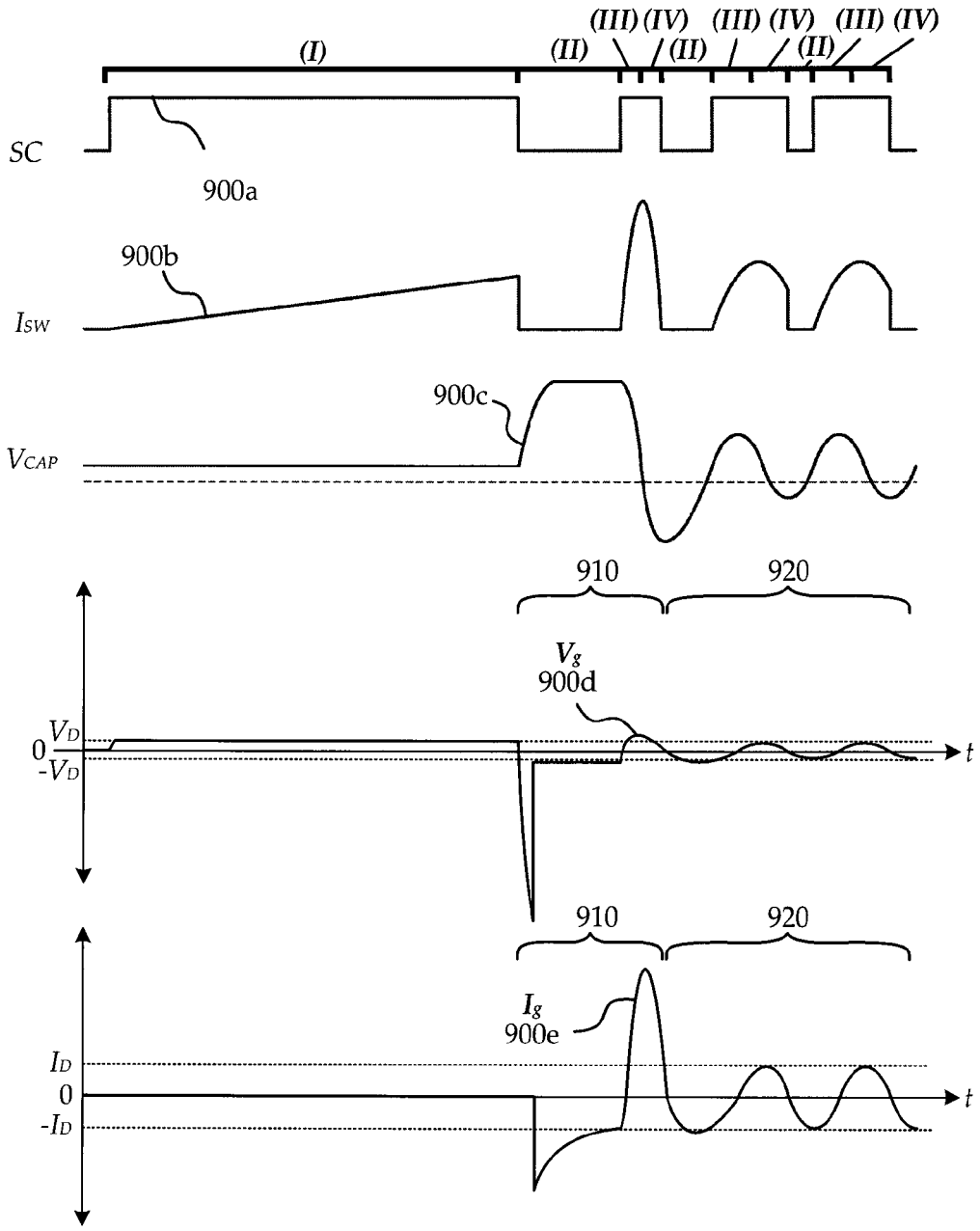
FIG. 9 illustrates various signals generated within and by the circuit depicted in FIG. 8.

The operation of the electric potential generating circuit 800 is best understood as operating in the following stages which are described also with reference to FIG. 9 which depicts signals generated in a time scale during the operation of the electric potential difference circuit 800, including the switch control signal SC 900*a* generated by the control unit 809, the current $I_{SW}$ 900*b* passing through the transistor switch 807 resulting from the switch control signal SC 900*a*, the voltage $V_{CAP}$ 900*c* of the capacitor 804, the electric potential difference $V_g$ 900*d* across the discharge gap 816, and the alternating gap current $I_g$ 900*e* passing through the bulk gas 150 across the discharge gap 816.

During a first stage (I), the transistor switch 807 is closed by the control unit 809. The transistor switch 807 begins charging both the inductor 802 and the ignition coil 805 via the primary winding, to a desired level of current through the third subcircuit. This level of current determines, first, the amount of energy stored within the inductor 802 to be transferred into the capacitor 804, and second, the amount of energy stored within the ignition coil 805.

During a second stage (II), the transistor switch 807 is opened by the control unit 809. The transistor switch 807 ends conducting and the capacitor 804 is charged to a positive voltage through the first subcircuit. At the same time the energy stored within the ignition coil 805 is released through the fourth subcircuit creating high voltage, say, of negative polarity in the discharge gap 816. If the second stage is following the first initial stage an electrical breakdown is actuated in the discharge gap 816.

During a third stage (III) the transistor switch 807 is closed by the control unit 809. The transistor switch 807 begins conducting and the capacitor 804 is discharged through the second subcircuit transferring the energy via the ignition coil 805 to the fourth subcircuit creating high voltage, which as illustrated for the embodiment shown, is of positive polarity in the discharge gap 816.

It should be noted that prior to breakdown, during the first stage (I), and the initial part of the second stage (II), due to the nature of the electrical properties of the bulk gas 150 at the time, no appreciable current flows between the electrodes of the discharge gap 816 even though a large potential difference $V_g$ 900*d* is applied thereto during the initial part of the second stage (II).

It should be noted that the first four stages (I), (II), (III), (IV) correspond to an initial discharge phase 910 during which the electric potential difference $V_g$ 900*d* is applied for the purpose of causing electrical breakdown of the bulk gas 150 as described hereinabove while having the dual breakdown capability described hereinbelow.

During a fourth stage (IV) the transistor switch 807 remains conducting, the current through the second subcircuit begins decaying and the capacitor 804 is recharged to negative voltage causing the rise of current through the first subcircuit which charges the inductor 802. By the end of the fourth stage (IV) the bulk gas 150 will have been subject to two initial electric potential pulses. Electrical breakdown of the bulk gas 150 may occur during the first electric potential pulse which occurs at the beginning of the second stage (II), or during the second electric potential pulse which occurs during stage (III). The curve for the gap current $I_g$ 900*e* depicted in FIG. 9 illustrates the gap current which would result from electrical breakdown occurring at the beginning of stage (II).

The second (II), third (III), and fourth (IV) stages are repeated for generating an oscillating driving potential during a combustion maintenance phase 920. For the duration of the ignition delay, the oscillating driving potential also serves, as described above, to ensure transition of the bulk gas 150 from electrical breakdown through to ignition.

As described above, the purpose of the oscillating driving potential is for physically causing the alternating gap current $I_g$ 900*e* to flow through the bulk gas 150 across discharge gap 816 such that avalanche ionization occurs but without any appreciable magnetic field formation or plasma pinching which normally occurs during arcing. This is achieved by reversal of polarity at a frequency sufficient to avoid the positive feedback loop that causes plasma pinching. Through this process, a non-equilibrium plasma is generated continuously. The continuous creation of non-equilibrium plasma allows the improvement and maintenance the combustion process by providing advantages which occur throughout the combustion process which are described above, moreover, without interruption. As described above, the alternating gap current $I_g$ 900*e* is such that the benefits obtain while avoiding arcing in the discharge gap 816. In some embodiments, the peak magnitude $V_D$ is such that the discharge current within the gap between the electrodes is at or just below the arcing threshold. In some embodiments, the peak magnitude $V_D$ is such that the discharge current is of a magnitude within a range of ±20% of the arcing threshold. As described hereinabove, a peak magnitude of the oscillating driving potential which physically causes an alternating gap current $I_g$ 900*e* having a peak magnitude of about one third of the peak gap current caused during the initial discharge phase 910 and a frequency of the oscillating driving potential which is roughly between 1 kHz-100 kHz are particularly well suited to producing the benefits described hereinabove. The peak magnitude of the alternating gap current $I_g$ 900*e*, i.e. its amplitude, during the combustion maintenance phase 920 which has been found to be particularly well suited to providing the benefits described hereinabove, is between 20 mA-100 mA. The second stage (II) becomes last in an operating sequence for stopping the oscillating driving potential at the discharge gap 816 thereby ceasing the generation of the alternating gap current $I_g$ 900*e*.

The control unit 809 generates the pattern for the switch control signal SC 900*a*, also referred to as the electric potential control signals, sent over the control line 808 to operate the transistor switch 807 wherein a frequency and pulse width of the switch control signal are used to control a frequency and magnitude of the electric potential difference $V_g$ 900*d* applied at the discharge gap 816 which in turn controls a frequency and magnitude of the alternating gap current $I_g$ 900*e* applied at the discharge gap 816 in accordance with the principles described hereinabove.

Another advantage of the potential difference generating circuit 800 is its dual breakdown capability. The operating sequence of the first, and the initial second, and third stages is used to secure the breakdown at the discharge gap 816 by providing during the initial discharge phase 910 two initial electric potential pulses which exceed the breakdown voltage as described below. Generally, even if the first electric potential pulse does not succeed in causing electrical breakdown it still creates partial ionization within the gap such that when the second electric potential pulse is applied electrical breakdown surely occurs.

At the first stage, the desired level of current is determined by the amount of energy stored within the ignition coil 805, or by the voltage the capacitor 804 is charged to by the end of second stage by transferring the energy stored within the inductor 802. The energy stored within the ignition coil 805 is approximately the same as the energy stored within the inductor 802. Therefore, this energy is released to the discharge gap 816 twice in a short period of time providing dual breakdown capability.

At the second stage, if the first breakdown at the discharge gap 816 has not yet occurred then the applied electric potential difference still creates an ionization of medium in the discharge gap 816 by means of high voltage, in accordance with the embodiment depicted, of negative polarity.

At the third stage, the ionization of medium in the discharge gap 816 facilitates the second breakdown in tandem with the discharging energy of the capacitor 804 through the second subcircuit, generating the second peak magnitude of, in accordance with the embodiment depicted, positive polarity.

Although the oscillating driving potential is illustrated as having a constant peak driving magnitude $V_D$ (causing a constant peak magnitude $I_D$ for the alternating gap current $I_g$ 900*e*) and a constant period T, in some embodiments the peak driving magnitude $V_D$ or the period T or both may vary with time as the bulk gas 150 undergoes combustion. The functional forms of the variations of either or both of the peak driving magnitude $V_D$ and the period T which give rise to an alternating gap current $I_g$ which is particularly well suited to give rise to the benefits hereinabove may depend upon a number of factors, including but not limited to, the particular size and shape of the combustion chamber 140, the particular conditions in the combustion chamber 140 including the temperature, pressure, and turbulence, the composition of the particular bulk gas 150, the size, form, and spacing of the electrodes 120, 130, where they are situated, the rate and manner at which the combustion chamber 140 is filled with bulk gas 150 and evacuated of the combustion products. The functions which are particularly well suited to providing the beneficial results described hereinabove may be experimentally determined in any particular application.

Although the embodiments have been described in the context of a combustion engine it should be understood that the system, method, and circuit described herein are applicable to any number of alternative possible combustion applications in which the control of combustion provided by the generated electric potential difference which physically causes alternating gap current according to the invention would still benefit the combustion processes. Such other combustion applications include combustion outside of an enclosed chamber, combustion applications which do not involve repeated ignition i.e. continuous flame processes such as flares, combustors, furnaces, lighters and the like, as well as spark assisted compression engines which do not rely on arc discharging for breakdown each cycle, but instead rely upon compression to cause ignition.

Although the specific embodiments described herein are in respect of applications which utilize the electrodes for causing electrical breakdown, it is to be understood that the benefits described hereinabove arise from the application of the oscillating driving potential to cause the alternating current between the electrodes. Some benefit will result from applying this oscillating potential during combustion, regardless of whether or not the electrodes or some other mechanism is what originally caused breakdown and ignition.

Although the embodiments described hereinabove have illustrated at least one electric potential pulse being applied before the oscillating driving potential, in some embodiments, the oscillating driving potential is applied before the at least one electric potential pulse. As long as the oscillating driving potential is continued for a significant duration after electrical breakdown it is believed that some benefit will be obtained.

Although the specific electrode configuration of a pair of separated electrodes has been described hereinabove, the invention may utilize other alternative kinds of electrode shapes and configurations being separated by space filled with the bulk gas.

In some embodiments of the invention, the control signals received by the electric potential difference generator 110 or the control unit 809 comprise only general timing signals, for example, signals which represent or determine generally when each combustion cycle is to begin, and could originate generally from a standard ECU controlling a standard sparking system. In these embodiments all of the subsequent timing, magnitude, and functional form for the initial electric potential pulse and the oscillating driving signal, are a result of the automatic functioning of respectively the electric potential difference generator 110 and the control unit 809. This allows for use of modules according to the invention within a standard combustion system if interposed appropriately between the standard ECU and the spark plug.

In some embodiments, the control signals comprise timing, magnitude, and/or other functional form parameter signals which are sent to the electric potential difference generator 110 or the control unit 809 once, and further signals comprise only of general timing signals as described above, except when the timing, magnitude, and/or other functional form parameters are updated.

In further embodiments, the control signals are sent each combustion cycle to the electric potential difference generator 110 or the control unit 809 and comprise general timing signals as well as further timing, magnitude, and/or other functional form parameter signals applicable to that combustion cycle.

Although the embodiments illustrated hereinabove utilize a specific mechanism for providing a continuously generated non-equilibrium plasma, namely, alternating current delivered to the bulk gas with use of electrodes, other bulk gas stimulators which deliver a physical influence to the bulk gas in order to create non-equilibrium plasma may be utilized. The generation of non-equilibrium plasma within the bulk gas causes the benefits described hereinabove, and those benefits do not depend upon the particular manner in which, or physical process by which, the non-equilibrium plasma is continuously generated. As such, embodiments of the invention contemplates other means of physically influencing the bulk gas to continuously create non-equilibrium plasma within the bulk gas, which may involve one or more of magnetic or electric processes, electromagnetic waves, kinetic, thermal, or chemical processes, and/or any other physical process which can be used to generate non-equilibrium plasma.

Alternatively, the electric potential generating circuit is other than a continuous plasma generating circuit and is for controlling combustion.

The embodiments presented are exemplary only and persons skilled in the art would appreciate that variations to the embodiments described above may be made without departing from the spirit of the invention. The scope of the invention is solely defined by the appended claims.

What is claimed is:

1. A system for controlling combustion of a bulk gas, the system comprising:

at least two electrodes for providing an electric potential difference varying over time to a portion of the bulk gas in a space spanned by the at least two electrodes when the bulk gas is in a ready for combustion state; and an electric potential difference generator for generating the electric potential difference and applying the electric potential difference to the at least two electrodes, the electric potential difference generated by the electric potential difference generator comprising:

an oscillating driving potential alternating in polarity and for causing an alternating current to flow within the portion of bulk gas, and wherein the oscillating driving potential has a functional form such that arcing within the bulk gas caused by the oscillating driving potential is avoided;

wherein the electric potential difference generated by the electric potential difference generator further comprises at least one initial electric potential pulse applied prior to the oscillating driving potential and having a peak magnitude exceeding a breakdown potential for the portion of the bulk gas for a duration sufficient to cause electrical breakdown within the portion of the bulk gas, and wherein the electric potential difference generator comprises:

an inductor connected to the power supply on a first side of the inductor;

a first diode, an anode of the first diode connected to a second side of the inductor;

a capacitor, a first side of the capacitor connected to the cathode of the first diode, a second side of the capacitor connected to a common ground;

an ignition coil comprising a primary and a secondary winding, a first end of the primary winding connected to the cathode of the first diode and the first side of the capacitor, each end of the secondary winding connected to different terminals of the at least two output terminals;

a second diode, an anode of the second diode connected to a second end of the primary winding of the ignition coil; and a transistor switch, a source of the transistor switch connected to the cathode of the second diode, a gate of the switch connected to the control unit for receiving the electric potential control signals, and a drain of the transistor switch connected to the common ground.

2. A system according to claim 1 wherein the alternating current has a peak magnitude within a range of ±20% of an arcing threshold of the bulk gas between the at least two electrodes.

3. A system according to claim 1 wherein the alternating current has a peak magnitude of about one third of a peak magnitude of a gap current flowing through the portion of the bulk gas during application of the at least one initial electric potential pulse.

4. A system according to claim 1 wherein the functional form of the oscillating driving potential has a frequency on the order of 10 kHz.

5. A system according to claim 1 wherein the functional form of the oscillating driving potential has a period on the order of one of $1\times10^{-3}$ s, $1\times10^{-4}$ s, and $1\times10^{-5}$ s.

6. A system according to claim 1 wherein the oscillating driving potential of the electric potential difference is applied for substantially an entire period for complete combustion of the bulk gas.

7. A system according to claim 1 wherein the electric potential difference generator comprises an input for receiving control signals comprising at least one general timing signal, and wherein the electric potential difference generator determines a time to commence generating the initial electric potential pulse with use of the at least one general timing signal.

8. A system according to claim 7 wherein the control signals comprise at least one parameter signal comprising at least one of timing, magnitude, and functional form parameter signals, and wherein the electric potential difference generator determines at least one of timing, magnitude, and functional form of at least one of the initial electric potential pulse and the oscillating driving potential.

9. A system according to claim 7 wherein the control signals are transmitted from an engine control unit.

10. A circuit for controlling combustion of a bulk gas, the circuit comprising:

an input terminal for receiving control signals;

a control unit connected to the input terminal for generating electric potential control signals with use of the control signals;

a power supply for providing an electrical power signal;

an electric potential difference generator connected to the power supply for receiving the electrical power signal and connected to the control unit for receiving the electric potential control signals, the electric potential difference generator for generating an electric potential difference varying over time with use of the electrical power signal, and with use of the electric potential control signals; and at least two output terminals connected to the electric potential difference generator for receiving the electric potential difference, the at least two output terminals for electrical connection to at least two external electrodes for outputting the electric potential difference, the at least two external electrodes for providing the electric potential difference to a portion of the bulk gas in a space spanned by the at least two external electrodes when the bulk gas is in a ready for combustion state, wherein the electric potential difference provided by the at least two external electrodes comprises:

an oscillating driving potential alternating in polarity and for causing an alternating current to flow within the portion of bulk gas, wherein the oscillating driving potential has a functional form such that arcing within the bulk gas caused by the driving potential is substantially avoided, wherein the electric potential difference provided by the at least two external electrodes further comprises at least one initial electric potential pulse applied prior to the oscillating driving potential and having a peak magnitude exceeding a breakdown potential for the portion of the bulk gas for a duration sufficient to cause electrical breakdown within the portion of the bulk gas, and wherein the electric potential difference generator comprises:

an inductor connected to the power supply on a first side of the inductor;

a first diode, an anode of the first diode connected to a second side of the inductor;

a capacitor, a first side of the capacitor connected to the cathode of the first diode, a second side of the capacitor connected to a common ground;

an ignition coil comprising a primary and a secondary winding, a first end of the primary winding connected to the cathode of the first diode and the first side of the capacitor, each end of the secondary winding connected to different terminals of the at least two output terminals;

a second diode, an anode of the second diode connected to a second end of the primary winding of the ignition coil; and a transistor switch, a source of the transistor switch connected to the cathode of the second diode, a gate of the switch connected to the control unit for receiving the electric potential control signals, and a drain of the transistor switch connected to the common ground.

11. A circuit according to claim 10 wherein the control unit controls the electric potential difference generator by controlling the transistor switch with the electric potential control signals.

12. A circuit according to claim 11 wherein the control unit causes the electric potential difference generator to generate the at least one initial electric potential pulse by providing:

a closed circuit between the cathode of the second diode and the common ground for a first duration;

an open circuit between the cathode of the second diode and the common ground for a second duration; and a closed circuit between the cathode of the second diode and the common ground for a third duration, wherein the at least one initial potential comprises two initial electric potential pulses.

13. A circuit according to claim 12 wherein the control unit causes the electric potential difference generator to generate the oscillating driving potential by repeatedly providing:

an open circuit between the cathode of the second diode and the common ground for fourth duration; and a closed circuit between the cathode of the second diode and the common ground for a fifth duration.

14. A circuit according to claim 13 wherein the alternating current has a peak magnitude of about one third of a peak magnitude of a gap current flowing through the portion of the bulk gas during application of the at least one initial electric potential pulse.

15. A circuit according to claim 10 wherein the functional form of the oscillating driving potential has a period on the order of one of $1\times10^{-3}$ s, $1\times10^{-4}$ s, and $1\times10^{-5}$ s.

16. A circuit according to claim 10 wherein the functional form of the oscillating driving potential has a frequency on the order of 10 kHz.

17. A circuit according to claim 16 wherein the functional form of the oscillating driving potential has a frequency of about 30 kHz.

18. A circuit according to claim 10 wherein the control unit controls the electric potential difference generator such that the oscillating driving potential of the electric potential difference is applied for substantially an entire period for complete combustion of the bulk gas.

19. A circuit according to claim 10 wherein the alternating current caused by the oscillating driving potential has an amplitude of about 20-100 mA.

20. A circuit according to claim 10 wherein the control signals comprise at least one general timing signal, and wherein the control unit determines with use of the at least one general timing signal a time to commence controlling the electric potential difference generator to generate the initial electric potential pulse.

21. A circuit according to claim 10 wherein the control signals comprise at least one parameter signal comprising at least one of timing, magnitude, and functional form parameter signals, and wherein the control unit determines with use of the at least one parameter signal how to control at least one of timing, magnitude, and functional form of at least one of the initial electric potential pulse and the oscillating driving potential generated by the electric potential difference generator.

22. A circuit according to claim 10 wherein the control signals are transmitted to the input terminal from an engine control unit.

23. A circuit according to claim 10 wherein the control unit controls the electric potential difference generator to vary over time at least one of a peak amplitude of the oscillating driving potential and a frequency of the oscillating driving potential.

24. A circuit for controlling combustion of a bulk gas, comprising:

an input terminal operably receiving control signals;

a control unit connected to the input terminal to create electric potential control signals;

a power supply which generates an electrical power signal;

an electric potential difference generator receiving the electrical power signal and the electric potential control signals and including:

an inductor connected to the power supply;

a first diode connected to a second side of the inductor;

a capacitor connected to the cathode of the first diode, a second side of the capacitor connected to a common ground;

an ignition coil comprising a primary and a secondary winding, a first end of the primary winding connected to a cathode of the first diode and a first side of the capacitor, each end of the secondary winding connected to different terminals of at least two output terminals;

a second diode connected to a second end of the primary winding of the ignition coil; and a transistor switch connected to the cathode of the second diode, a gate of the switch connected to the control unit for receiving the electric potential control signals, and a drain of the transistor switch connected to the common ground;

the electric potential difference generator creating an electric potential difference varying over time;

the at least two output terminals electrically connected to the electric potential difference generator and receiving the electric potential difference, the at least two output terminals in electrical connection to at least two external electrodes;

the at least two external electrodes providing an electric potential difference to a portion of the bulk gas in a space spanned by the at least two external electrodes;

wherein the electric potential difference provided by the at least two external electrodes includes:

an oscillating driving potential alternating in polarity and causing an alternating current to flow within the portion of bulk gas;

the oscillating driving potential including a functional form such that arcing within the bulk gas caused by the driving potential is substantially avoided;

the electric potential difference provided by the at least two external electrodes further includes at least one initial electric potential pulse applied prior to the oscillating driving potential and having a peak magnitude exceeding a breakdown potential for the portion of the bulk gas for a duration sufficient to cause electrical breakdown within the portion of the bulk gas.

* * * * *